United States Patent [19]

Camp

[11] 4,312,273

[45] Jan. 26, 1982

[54] SHAPED CHARGE MOUNTING SYSTEM

[75] Inventor: Donald L. Camp, Mansfield, Tex.

[73] Assignee: Shaped Charge Specialist, Inc., Mansfield, Tex.

[21] Appl. No.: 138,140

[22] Filed: Apr. 7, 1980

[51] Int. Cl.[3] ..... E21B 7/00; E21B 43/117; F42B 3/08

[52] U.S. Cl. ..... 102/310; 102/275.12; 175/4.6

[58] Field of Search ..... 102/310, 320, 321, 331, 102/275.12; 175/4.6

[56] References Cited

U.S. PATENT DOCUMENTS

| | | | |
|---|---|---|---|
| 2,756,677 | 7/1956 | McCullough | 102/310 |
| 2,764,938 | 10/1956 | Harcus | 175/4.6 |
| 3,048,101 | 8/1962 | Lebourg | 175/4.6 |
| 3,078,797 | 2/1963 | Blair | 175/4.6 |
| 3,282,213 | 11/1966 | Bell et al. | 102/310 |
| 3,650,212 | 3/1972 | Bauer | 175/4.6 X |
| 3,739,723 | 6/1973 | Hakala | 102/310 |

*Primary Examiner*—David H. Brown
*Attorney, Agent, or Firm*—Richards, Harris & Medlock

[57] ABSTRACT

A mounting system for shaped charge explosive perforation of an oil well casing (24) includes an elongated support panel (28) having spaced apertures (44, 46) receiving cylindrical-conical shaped charges (26) retained by spring wire clips (30). The shaped charge (26) has an open mouth cylindrical portion (36) with a shoulder (52) at a reduction to the diameter of the apertures (44, 46), and a circumferential groove (54) spaced from the shoulder (52) a distance about equal to the thickness of the panel (28). The spring wire clip (30) has a semicircular portion (78) mating in the circumferential groove (54) for about 180°, and has oppositely directed radical extensions (70, 72) terminating in hooks (74, 76) which extend above the panel (28) to receive and position primer cord (32) seated in a transverse groove (62) in the apex (64) of the conical portion (34) of the shaped charge (26).

10 Claims, 4 Drawing Figures

SHAPED CHARGE MOUNTING SYSTEM

TECHNICAL FIELD

The present invention relates to shaped charge explosives for perforating oil well casings, and more particularly to an improved mounting system for shaped charges.

BACKGROUND ART

Explosive shaped charges are used for perforating oil well casings. The shaped charge includes a conical portion and an open-mouth cylindrical portion directing detonated explosive outwardly therefrom. A plurality of charges are mounted in the web of an elongated support channel and serially connected by a ribbon detonator or primer cord. The channel is loaded into an elongated tubular gun barrel. The gun barrel is lowered into the well, and the radially outwardly directed charges perforate the gun barrel and the well casing upon detonation.

Hakala, U.S. Pat. No. 3,739,723, shows a mounting system for shaped charges. An elongated channel member has spaced apertures in the web thereof. The charges are inserted, cylindrical mouth portion first, into the apertures until stopped by a raised shoulder at the base of the conical portion. A spring clip engages the apex tip of the conical portion to secure primer cord in contact therewith. The spring clip diverges from the apex in conical profile and then extends around the edge of the channel member to engage the backside thereof and thus retain the charge in the aperture.

SUMMARY OF THE INVENTION

The present invention provides a simple and efficient shaped charge mounting system. The system facilitates fast and easy mounting of shaped charges with accurate and reliable positioning at a minimum of cost. The mounting system also provides enhanced retention characteristics.

In one desirable aspect of the invention, the mounting system enables primer cord to be positioned and retained against the apex of the shaped charge after the shaped charge has been secured to a support panel. This affords flexibility in assembly sequence and reduces overall assembly time.

In accordance with the invention, a support panel, a cylindrical-conical shaped charge and a spring wire clip combination is provided. The panel has charge receiving apertures formed therethrough. The open-mouth cylindrical portion of the shaped charge has a shoulder at a reduction to the diameter of the apertures, and a circumferential groove spaced from the shoulder a distance about equal to the thickness of the panel. The conical portion of the charge has a transverse groove in the apex thereof. A spring wire clip mates in the circumferential groove for at least about 180° and has oppositely directed extensions terminating in hooks which extend above the panel to about the level of and generally laterally of the transverse apex groove to receive and position primer cord seated in the apex groove.

The shaped charge is inserted, conical portion first, into a receiving aperture in the panel. The clip is then inserted in the circumferential groove to retain the shaped charge on the panel. The panel is engaged between the shoulder and the clip on opposite sides of the panel. The primer cord is then positioned in the transverse apex groove and retained by the hooks.

DETAILED DESCRIPTION

Figure 1:
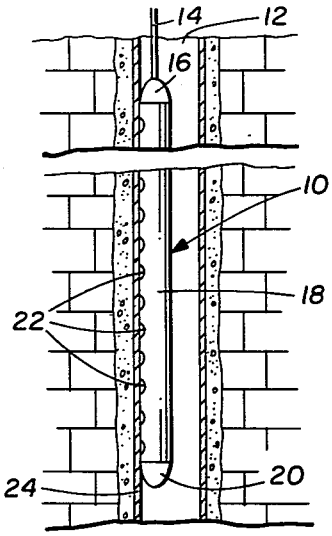
FIG. 1 is an elevation view of a perforating gun in a well.

Referring to FIG. 1, there is shown a detonator gun 10 lowered into a well bore 12. Gun 10 is attached to a suspension cable 14 via cable head 16. Electrical circuit connections are run along the cable and through the cable head to be connected to a detonator as shown in said U.S. Pat. No. 3,739,723. The gun includes an intermediate tubular barrel 18 and a bottom closure 20. Tubular gun barrel 18 is hollow and contains a plurality of shaped charges. The exterior of gun barrel 18 is thinned at regularly spaced zones 22. The purpose of the thinned zones 22 is to provide preselected locations in the barrel 18 through which the blast from the shaped charges can pass. This minimizes dissipation of projectile energy in breaking out of barrel 18, to afford better perforation of well casing 24.

Figure 2:
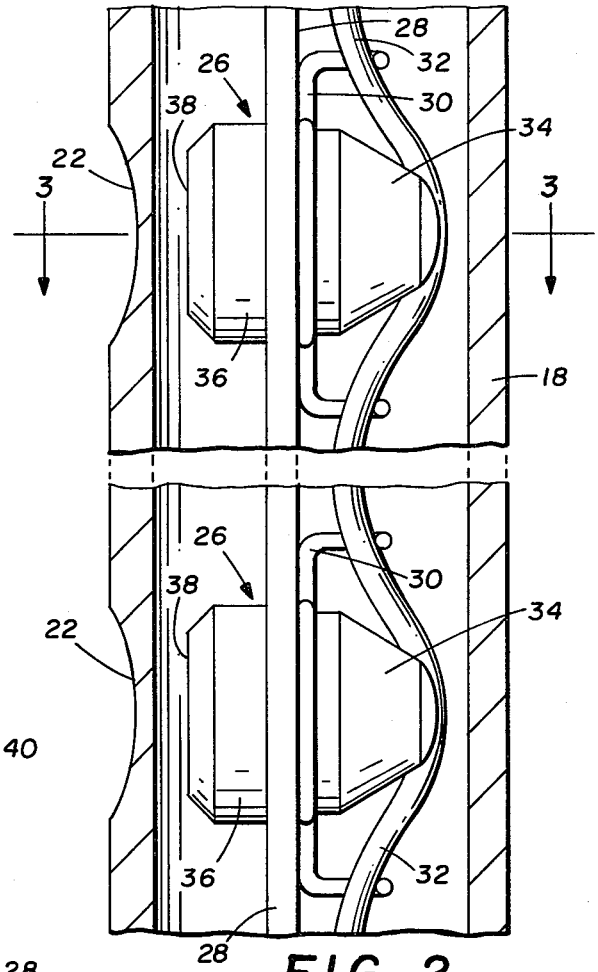
FIG. 2 is an enlarged longitudinal sectional view of a portion of the gun of FIG. 1.

FIG. 2 shows an enlarged sectional view of a portion of the gun barrel 18. A plurality of cylindrical-conical shaped charges 26 are mounted in single row on an elongated support panel or channel 28 which, in turn, is supported within the gun barrel and extends vertically therein. Shaped charges 26 are secured to panel 28 by spring wire clips 30, which clips also serve to position and retain a ribbon detonator or primer cord 32. Shaped charge 26 is an integral member with a conical portion 34 and a cylindrical portion 36 having an open-mouth 38 directing detonated explosive outwardly through thinned zone 22.

Figure 4:
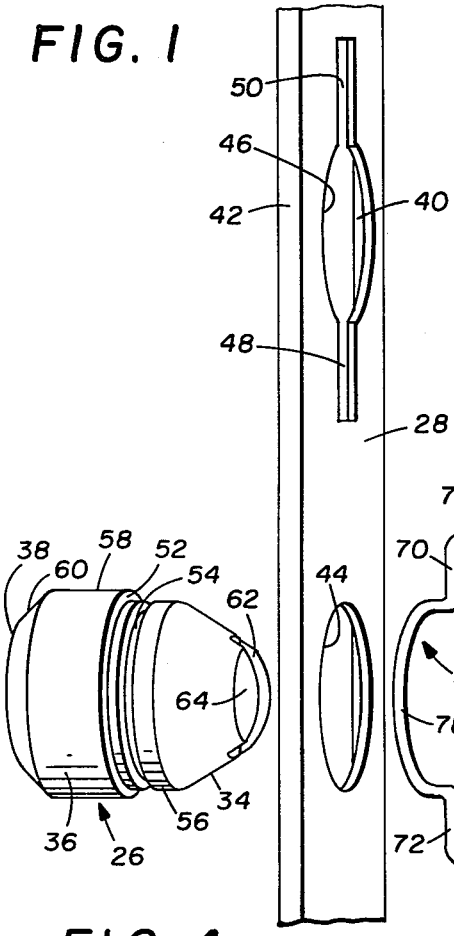
FIG. 4 is an exploded perspective view of a shaped charge, support panel, spring wire clip, and primer cord.
Figure 3:
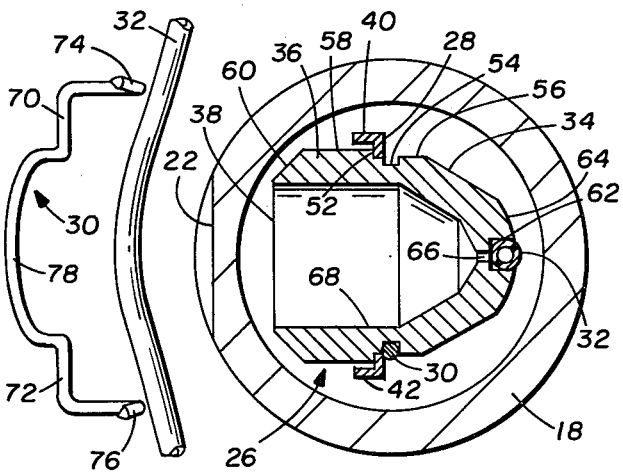
FIG. 3 is a sectional view taken along line 3—3 of FIG. 2.

Referring to FIGS. 3 and 4, support panel 28 has 90° turned end flanges 40 and 42 extending along its length for added structural rigidity. A plurality of alternately apertures 44 and 46 are formed in panel 28 for receiving shaped charges 26. Aperture 46 has longitudinal extensions or slots 48 and 50 through which primer cord 32 may be passed to afford alternating oppositely directed charges, to be more fully described hereinafter.

Cylindrical or mouth portion 36 of the shaped charges has a shoulder 52 at a reduction to the diameter of receiving apertures 44 and 46, and a circumferential groove 54 spaced from shoulder 52 a distance about equal to the thickness of panel 28. Cylindrical or mouth portion 36 thus has a reduced section 56 adjacent conical portion 34 and of diameter about equal to the diameter of receiving apertures 44 and 46. Cylindrical portion 36 has an enlarged section 58 between mouth 38 and reduced section 56 and of greater diameter than apertures 44 and 46. Enlarged section 58 is stepped down to reduced section 56 by radial shoulder 52. Shaped charges 26 are thus insertable, conical portion 34 first, into panel apertures 44 and 46 with a stop provided by engagement of shoulder 52 against panel 28. The open mouth of the charge is bevelled at 60.

Conical portion 34 of the charge has a transverse groove 62 in the apex 64 thereof. An internal passage 66 communicates between the interior 68 of the charge and groove 62. Primer cord 32 is positioned in and extends through groove 62.

Spring wire clip 30 mates in circumferential groove 54 for at least about 180°. The clip has oppositely directed extensions 70 and 72 terminating in hooks 74 and 76. These hooks extend above panel 28 and generally laterally of transverse groove 62 at about the level of transverse groove 62 to receive and position primer cord 32 seated in transverse groove 62.

Extensions 70 and 72 extend generally radially away from circumferential groove 54 along the longitudinal direction of panel 28. Hooks 74 and 76 extend generally perpendicularly away from panel 28 and then generally parallel to the panel at about the level of transverse groove 62. Hooks 74 and 76 bear against the top of primer cord 32. The bottom of primer cord 32 is seated in transverse groove 62 between hooks 74 and 76. Primer cord 32 is slightly deflected as it passes through transverse groove 62 beneath hooks 74 and 76 for lightly biased retention in transverse groove 62.

Spring clip 30 has a substantially semicircular portion 78 semicircumferentially engaging panel 28 and shaped charge 26. The top of hooks 74 and 76 are bent back toward the direction of the arch of semicircular portion 78. The cross-sectional diameter of spring wire 30, FIG. 3, is greater than the depth of groove 54 such that the outer diameter of semicircular portion 78 mated in groove 54 is greater than the diameter of apertures 44 and 46. Panel 28 is engaged between shoulder 52 and semicircular portion 78 of clip 30 on opposite sides of panel 28, to thus retain shaped charge 26 on the panel.

Shaped charge 26 is inserted through aperture 44 to seat shoulder 52 against panel 28. Spring wire clip 30 is then inserted in groove 54 in a direction perpendicular to the axis of charge 26, (i.e., the directions of insertion of charge 26 and spring clip 30 are perpendicular). The ends of semicircular portion 78 are slightly deflected outwardly during insertion in groove 54 and provide resiliently biased retention of spring clip 30 in groove 54. Primer cord 32 is then strung through apex groove 62 beneath hooks 74 and 76. This primer cord has a certain degree of stiffness which in combination with the relatively oriented levels of hooks 74 and 76 and groove 62 insure proper communication with passage 66.

It is sometimes desirable to perforate the well casing with oppositely directed charges. For such applications, the shaped charge for aperture 46, FIG. 4, is inserted in the opposite direction to the shaped charge for aperture 44. Primer cord 32 then extends through slots 48 and 50 to the other side of panel 28 to pass through the apex groove in the conical portion of the oppositely directed shaped charge.

It is recognized that various alternatives and modifications are possible within the scope of the invention.

I claim:

1. A shaped charge system comprising:

an elongated panel having charge receiving apertures formed therethrough;

a cylindrical-conical shaped charge structure having a mouth portion with a shoulder at a reduction to the diameter of said apertures and a circumferential groove spaced from said shoulder a distance about equal to the thickness of said panel and a transverse groove in the apex thereof; and a spring wire clip to mate in said circumferential groove for at least about 180° and having oppositely directed extensions terminating in hooks which extend above said panel and generally laterally of said transverse groove at about the level of said transverse groove to receive and position primer cord seated in said transverse groove.

2. The invention according to claim 1 wherein the diameter of the outer periphery of said clip mated in said groove is greater than said diameter of said apertures in said panel, and wherein said panel is engaged between said shoulder and said clip on opposite sides of said panel.

3. The invention according to claim 1 wherein said oppositely directed extensions of said clip extend generally radially away from said circumferential groove and along said panel, and said hooks extend away from said panel.

4. The invention according to claim 2 wherein said hooks extend generally perpendicularly away from said panel and then generally parallel to said panel at about said level of said transverse groove.

5. The invention according to claim 3 wherein said hooks bear against the top of said primer cord, and the bottom of said primer cord is seated in said transverse groove between said hooks, said primer cord being slightly deflected as it passes through said transverse groove beneath said hooks for lightly biased retention in said transverse groove.

6. A shaped charge system comprising:

an elongated panel having charge receiving apertures formed therethrough;

a shaped charge structure having a conical portion and an open-mouth cylindrical portion, said conical portion having a transverse groove in the apex thereof, said cylindrical portion having a reduced section adjacent said conical portion and of diameter about equal to the diameter of said apertures, said cylindrical portion having an enlarged section between said mouth and said reduced section and of diameter greater than said apertures, said enlarged section being stepped down to said reduced section by a radial shoulder such that said charge structure is insertable conical portion first into said panel aperture with a stop provided by engagement of said shoulder against said panel; and a spring wire clip mounted to said charge structure and engaging said panel on the opposite side from said shoulder to retain said charge structure in said aperture, said clip having hooks positioning a primer cord seated in said transverse groove.

7. The invention according to claim 6 wherein said clip has oppositely directed extensions along said panel, and said hooks extend above said panel and generally laterally of said transverse groove at about the level of said transverse groove.

8. The invention according to claim 6 wherein said clip has a substantially semicircular portion semicircumferentially engaging said panel and said charge structure, said clip having a pair of substantially opposite outward radial extensions extending longitudinally along said panel.

9. The invention according to claim 8 wherein said hooks extend away from said panel and then are bent generally laterally of said transverse groove back toward the direction of the arch of said semicircular portion.

10. A shaped charge system comprising:

(A) an elongated panel having charge receiving apertures formed therethrough;

(B) an integral shaped charge structure comprising:
(i) a conical portion having a transverse groove in the apex thereof; and
(ii) a cylindrical portion comprising:
(a) a reduced section adjacent said conical portion and having a diameter substantially the same as said apertures;
(b) an open mouth at the end opposite said conical portion;
(c) an enlarged section between said mouth and said reduced section and of greater diameter than said apertures;
(d) a radial shoulder stepping said enlarged section down to said reduced section, such that said charge structure is inserted conical portion first into said aperture with a stop provided by engagement of said shoulder against said panel; and
(e) a circumferential groove formed in said reduced section and spaced from said shoulder by a distance about equal to the thickness of said panel; and
(C) a spring wire clip mating in said circumferential groove for at least about 180° and having a pair of opposite extensions terminating in hooks which extend above said panel to receive and position primer cord in said transverse groove.

* * * * *